United States Patent [19]

Liu

[11] Patent Number: 4,884,317

[45] Date of Patent: Dec. 5, 1989

[54] HINGE UNITS FOR JOINING A CASE AND ITS LID

[76] Inventor: Ping-Hsiung Liu, No. 15, Lane 107, Fu Kang St., Taipei, Taiwan

[21] Appl. No.: 307,049

[22] Filed: Feb. 7, 1989

[51] Int. Cl.[4] ..... E05F 1/12

[52] U.S. Cl. ..... 16/289; 16/292; 16/297; 16/306; 16/325; 16/333; 16/341; 16/342; 16/343; 16/385; 16/DIG. 13

[58] Field of Search ..... 16/16, 286, 289, 290, 16/292, 223, 246, 297, 306, 325, 333, 341, 342, 343, 334, 335, 385, DIG. 13; 49/396; 220/334, 335

[56] References Cited

U.S. PATENT DOCUMENTS 4,424,606 1/1984 Sorimachi ..... 16/289

*Primary Examiner*—Richard K. Seidel
*Assistant Examiner*—Edward Brown
*Attorney, Agent, or Firm*—Morton J. Rosenberg; David I. Dlein

[57] ABSTRACT

This invention relates to the design and construction of hinge units for joining a case and its corresponding lid, which comprises: a pair of bend units with a receptacle body in between for keeping a spring integrally connected to a side wall of a case; a guide member slidably inserted in the hollow space of the receptacle body and supported by the spring; a joint plate having a through opening running transversely through the lower portion thereof to be joined with the bend units by means of an inserted pin; and a socket integrally connected to a side wall of a lid for receiving a portion of the joint plate therein.

2 Claims, 4 Drawing Sheets

HINGE UNITS FOR JOINING A CASE AND ITS LID

BACKGROUND OF THE INVENTION

1. Field Of The Invention

This invention relates to the design and construction of hinge units for joining a case such as a turntable and its lid.

2. Prior Art

Conventionally, a transparent lid made of plastic or the like is hinged on a side wall of a turntable by means of screws to prevent the accessories such as the platter, the cartridge and so on from dust. The installation of said hinge on the side wall of the turntable and its corresponding lid is labor and time consuming.

SUMMARY OF THE INVENTION

Accordingly, it is an object of the present invention to provide improved hinge units for joining a case and its lid which are easy to manufacture, install and operate.

With the above objectives in view, this invention provides improved hinge units for joining a case and its lid which obviate the inconvenience hitherto, the structure of each of which comprises: a pair of bend units with a receptacle body inbetween for keeping a spring, integrally connected to a side wall of a case; a guide member slidably inserted in the hollow space of the receptacle body for retaining the upper portion of the spring; a joint plate having a perforation running transversely through the lower portion thereof to be joined with said bend units by means of an inserted pin; and socket means having a socket for receiving said joint plate integrally connected to a side wall of a lid.

DETAILED DESCRIPTION OF THE PREFERRED EMBODIMENT

Figure 1:
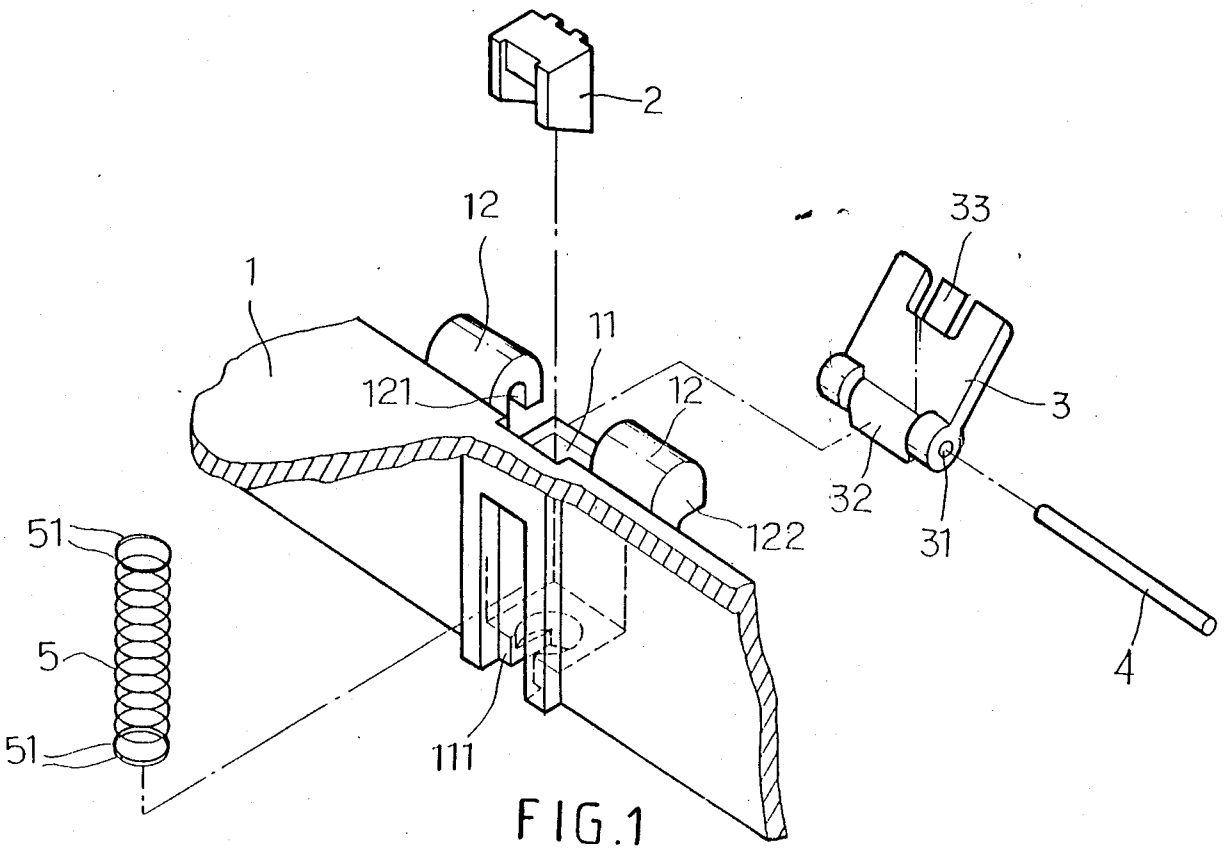
FIG. 1 is an exploded and perspective view of an improved hinge unit and a related case according to the present invention.

The following is a detailed description of the best presently contemplated embodiment of the invention. This description is not to be taken in a limiting sense, but is made merely for the purpose of illustrating the general principles of the invention.

Referring to FIGS. 1, 2, 3 and 4, the preferred embodiment of improved hinge units for joining a case and its corresponding lid according to the present invention is shown. Each hinge unit comprises: a pair of bend units 12 having opposed tunnel-shaped passages 121 which run horizontally and terminate by respective side plates 122, are integrally connected to a side wall 10 of a case 1 in spaced apart relation; a receptacle body 11 including a bottom wall 111 having a recess formed therein for retaining the lower end portion 51 of a spring 5 and a circumferential wall extending upward from the periphery of said bottom wall 111, integrally connected to said side wall 10 of the case 1 between and slightly below the bend units 12.

An opening is formed in the side wall 10 of the case 1 to communicate the inner space of the receptacle body 11 and the opposite side of the side wall 10.

A guide member 2 having a top plate with a flat top surface and a pair of opposite side plates is slidably inserted in the inner space of the receptacle body 11 and supported by the upper end portion of the spring 5 in a space defined by said top plate opposite side plates of the guide member 2 and the inner side walls of the receptacle body 11.

A joint plate 3 having a through opening 31 extending transversely through the lower portion which has bottom slope 32 for stably supporting the lid 6 in an open position is joined with said bend units 12, by means of a pin 4 inserted into said through opening 31 of the plate 3 while the two end portions of pin 4 protruding from the through opening 31 are caught in the tunnel-shaped passages 121 of the bend units 12 as the joint plate 3 is pushed upward by the compressed spring 5 through the guide member 2.

The joint plate 3 further comprises a resilient lock means 33, which has an arrowed top end disposed in a grove 34.

A socket means 61 having a notch 612 formed in a inner side wall thereof for engaging with the arrowed end of the lock means 33 of the inserted joint plate 3 is integrally connected to the side wall of the lid 6.

Figure 2:
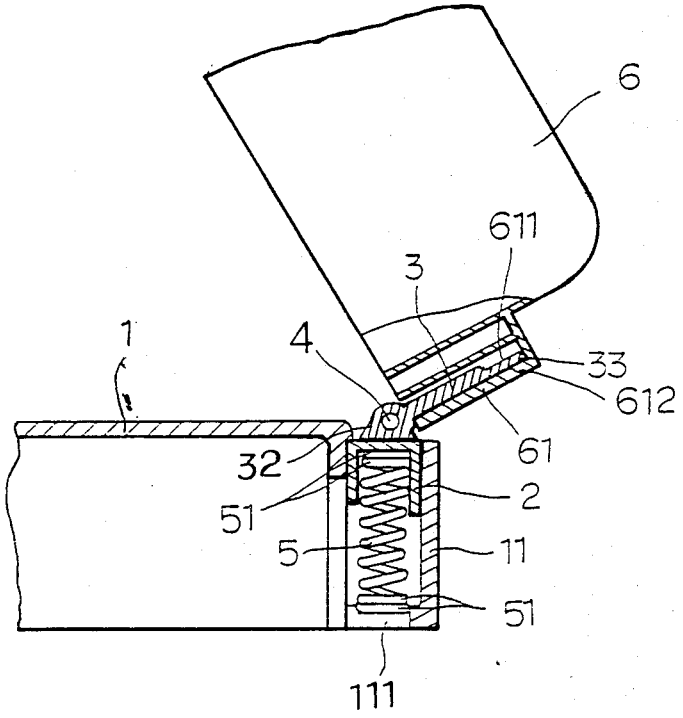
FIG. 2 is a cross-sectional view of an improved hinge unit assembled on a case and a corresponding lid which is located in an open position.
Figure 3:
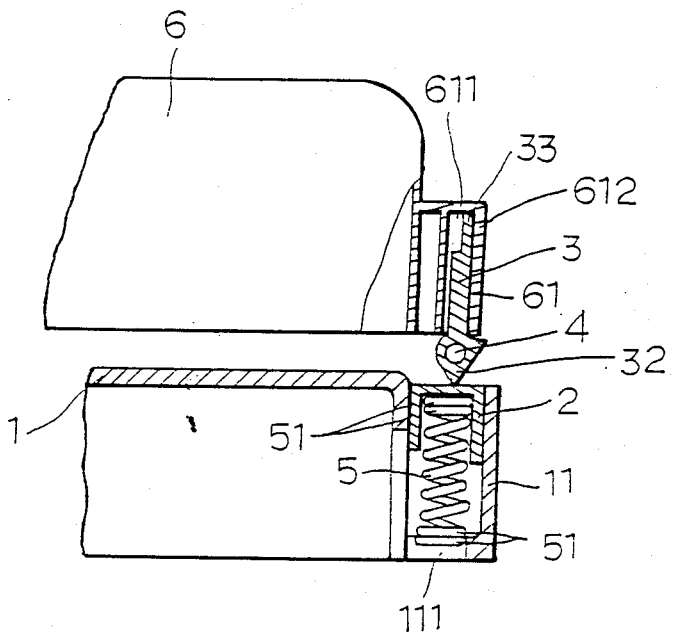
FIG. 3 is a cross-sectional view of an improved hinge unit assembled on a case and a corresponding lid which is located in a closed position.
Figure 4:
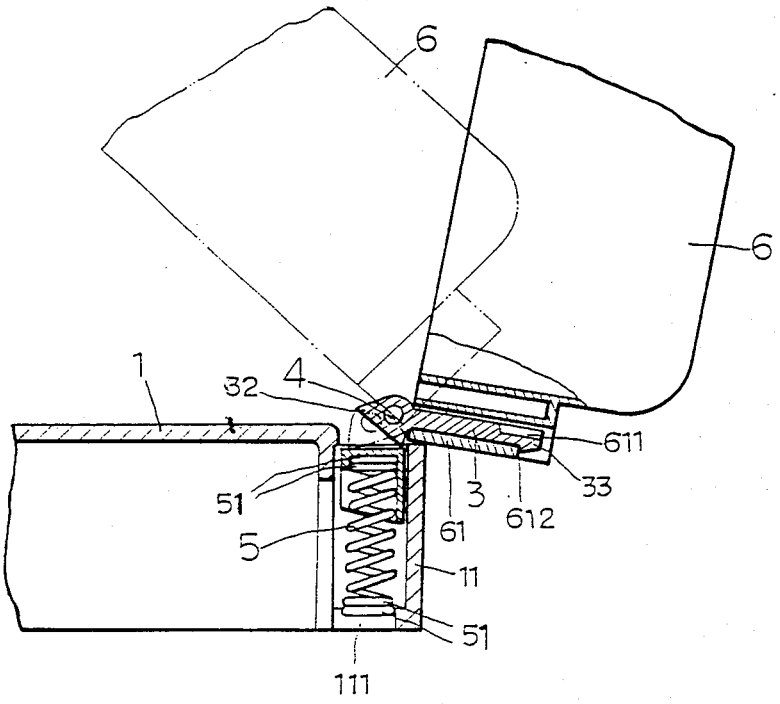
FIG. 4 is a cross-sectional view of an improved hinge unit assembled on a case and a corresponding lid which is located in a wide open position.

In operation, the lid 6 can be turned between an open position (as shown in FIG. 2) and a closed position (as shown in FIG. 3). The bottom slope 32 of the joint plate 3 rests on the flat surface of the guide member 2 so that the lid 6 is stably maintained in its open position. While the lid 6 is closed, the spring 5 is compressed through the guide member 2 by the lower most end of the joint plate 3, and such facilitates the opening operation of the lid 6. Certainly, a wide open position with a obtuse angle between the case 1 and the lid 6 as shown in FIG. 4 can further be reached when necessary.

By the aforementioned construction of the improved hinge units according to the present invention, it can be seen that they have advantages regarding their design and manufacture. These advantages result in decreased manufacturing costs and easy installation and operation.

It will be appreciated, of course, that although a particular embodiment of the invention has been described, modification may be made. It is intended in the following claims to cover all modifications which fall within the scope of the invention.

What is claimed is:

1. Improved hinge units for joining a case and a lid, each unit comprising:

a pair of bend units integrally connected to a side wall of said case in spaced apart relation, each of said bend units having tunnel-shaped passages extending horizontally and aligned one with respect to the other;

a receptacle body including a bottom wall and a circumferential wall extending upwardly from the periphery of said bottom wall, said receptacle body being integrally connected to said side wall of the case and positionally located between and slightly below the bend units;

a spring disposed within said receptacle body;

a guide member having a top plate with a flat top surface and at least a pair of opposing side plates, said guide member being slidably received within said receptacle body and supported by said spring;

a joint plate having a through opening formed in a lower portion of said joint plate, said through opening extending transversely through said lower portion of said joint plate, said lower portion of said joint plate including a bottom slope member having a plurality of surfaces, whereby a different one of said surfaces is in contiguous contact with said flat top surface of said guide member top plate responsive to positioning of said lid relative to said case for stably maintaining said lid position, said joint plate having an upper portion wherein there is formed a resilient lock member;

a pin extending through said through opening formed in said lower portion of said joint plate and having opposing ends engaged in said tunnel-shaped passages of the bend units; and a socket member integrally connected to a side wall of said lid, said socket member having a cavity adapted to receive said upper portion of said joint plate and provide locking engagement with said resilient lock member.

2. The improved hinge units for joining a case and a lid as recited in claim 1 wherein each unit further comprising an opening formed through the side wall of the case to provide open communication between an interior space of the receptacle body and an interior portion of said case.

* * * * *